US009629470B2

(12) United States Patent
Bussell et al.

(10) Patent No.: US 9,629,470 B2
(45) Date of Patent: Apr. 25, 2017

(54) COMPACTLY COLLAPSIBLE CHAIR CANOPY

(76) Inventors: Stuart Bussell, Carlsbad, CA (US); Mitchell L. Bussell, New Hartford, CT (US)

( * ) Notice: Subject to any disclaimer, the term of this patent is extended or adjusted under 35 U.S.C. 154(b) by 892 days.

(21) Appl. No.: 13/357,436

(22) Filed: Jan. 24, 2012

(65) Prior Publication Data

US 2013/0019915 A1 Jan. 24, 2013

Related U.S. Application Data

(60) Provisional application No. 61/572,683, filed on Jul. 20, 2011.

(51) Int. Cl.
*A47C 7/66* (2006.01)

(52) U.S. Cl.
CPC ..... *A47C 7/66* (2013.01)

(58) Field of Classification Search
USPC ..... 135/126, 161
See application file for complete search history.

(56) References Cited

U.S. PATENT DOCUMENTS

| | | | | |
|---|---|---|---|---|
| 3,190,300 | A * | 6/1965 | Wear N | 135/126 |
| 4,506,689 | A * | 3/1985 | Fiddler | 135/133 |
| 4,915,120 | A | 4/1990 | Ziolkowski | |
| 5,059,463 | A * | 10/1991 | Peters | 428/64.1 |
| 5,154,473 | A * | 10/1992 | Joranco | 297/184.15 |
| 5,320,405 | A | 6/1994 | Foster et al. | |
| 5,645,096 | A | 7/1997 | Hazinski et al. | |
| 6,109,281 | A | 8/2000 | Lowenthal | |
| 6,109,282 | A | 8/2000 | Yoon | |
| 6,170,100 | B1 * | 1/2001 | Le Gette et al. | 5/417 |
| 6,478,038 | B1 * | 11/2002 | Le Gette et al. | 135/96 |
| 6,942,005 | B2 * | 9/2005 | Le Gette et al. | 160/368.1 |
| 7,048,333 | B2 * | 5/2006 | Martinez | 297/184.11 |
| 7,225,822 | B1 | 6/2007 | Zheng | |
| 7,252,106 | B2 * | 8/2007 | Conforti | 135/117 |
| 7,302,957 | B2 | 12/2007 | Ross | |
| 7,753,063 | B1 | 7/2010 | Laws | |
| 2003/0010371 | A1 | 1/2003 | Langley | |
| 2004/0255996 | A1 | 12/2004 | Ross | |
| 2006/0249191 | A1 * | 11/2006 | Zheng | 135/126 |

* cited by examiner

*Primary Examiner* — Noah Chandler Hawk
(74) *Attorney, Agent, or Firm* — George S. Levy

(57) ABSTRACT

A canopy adapted to be mounted on a chair having a backrest. This canopy is supported by a frame including a closed loop rod and an open arc rod, each rod made of flexible material. The canopy also includes a first sheet secured throughout its entire perimeter to the closed loop rod and a second sheet secured along its back edge to the top edge of the first sheet and along its front edge to at least a portion of the open arc rod. The canopy also includes anchors configured to attach said canopy to said chair's backrest. The canopy can be compactly collapsed by folding the first sheet over the second sheet, thereby forming a stack, twisting the stack into three sets of loops, shifting the left loops in front of the right loops and folding the middle loops in front of the left loops.

13 Claims, 13 Drawing Sheets

COMPACTLY COLLAPSIBLE CHAIR CANOPY

This application claims priority pursuant to 35 U.S.C. Par 119(e)(i) to U.S. Provisional Application 61/572,683, filed Jul. 20, 2011, titled Compactly Collapsible Chair Canopy naming Stuart Bussell as inventor.

INCORPORATION BY REFERENCE

This application incorporates by reference U.S. provisional application number U.S. 61/572,683.

FIELD OF THE INVENTION

This invention relates to canopies, sunshades or sunshields for chairs, and in particular to a canopy of very simple and light construction which can be easily reduced to a compact configuration for storage and transportation and later opened to function properly on a plurality of chairs with backrests, including foldable beach and quad chairs.

BACKGROUND

There exists a need for a low-cost, easily manufactured, efficient canopy which can be quickly attached to portable chairs lacking canopies to shield their occupants against the light and heat from the sun. Ideally such a canopy would have a simple structure, be quick and easy to deploy for use on a plurality of chair types and models, and be quick and easy to collapse into a compact configuration for storage and transport. The compact configuration should be light and small enough so that the canopy can be easily attached to the chair for ease of transport with the chair.

U.S. Pat. No. 7,431,389 by Reeb discloses a canopy chair that makes use of a support structure using pivotally attached rigid bars.

A collapsible automobile shade is described in U.S. Pat. No. 5,024,262 by Huang comprising a single planar sheet.

U.S. Pat. No. 7,302,957 by Ross describes a tent that can also be mounted as a canopy on the back of a chair, but its shape, size and structure are primarily intended for a tent and are poorly suited to be used as a dedicated chair canopy.

Preferred embodiments of the present invention have a combination of elements that enable it to be compactly folded and eliminate the need for cumbersome hardware that can make assembly, disassembly, and transport more laborious. No rigid framework elements, pivot hardware, nor specific attachment points are used for the main framework of the present invention. Neither are any tie downs or stakes used to maintain the structure. Also, when preferred embodiments of the present invention are unfolded from the collapsed configuration, the shape of the framework is defined by the sheets of the invention so that users do not need to deform the framework in order to install it on a chair. Further features, aspects, and advantages of the present invention over the prior art will be more fully understood when considered with respect to the following detailed description and claims.

SUMMARY OF THE INVENTION

This patent discloses a compactly collapsible chair canopy comprising two attached sheets. The first sheet is held flat and open by a flexible closed loop rod and the other sheet is held by a flexible open arc rod. The invention also includes anchors for fastening the canopy to the backrest of a chair.

The canopy can be easily compactly folded to reduce its size for storage and transport and simply unfolded later for use. The first sheet is first folded on top of the second around a hinge at the junction between them. The two overlaying sheets are then twisted and additionally folded to form sets of stacked rings or loops of layers. In preferred embodiments, the anchors used to fasten the canopy to the chair also keep the canopy in its compactly collapsed configuration. For unfolding, the sets of stacked loops are unstacked, and the canopy naturally unfolds such that the two sheets overlay each other absent any rings or loops. Installation onto a chair involves attaching the anchors to the chair and extending the second sheet into its open configuration. In some preferred embodiments, a rib can be used to keep the second sheet extended in case of wind.

In accordance with the described embodiments, this invention describes a compactly collapsible chair canopy comprised of the following:

1. At least two thin flexible strips, wires or rods henceforth called rods. The first rod in the shape of a closed loop, and the second in the shape of an open arc. These rods operate as a supporting framework for the structure for the canopy. They deform reversibly and generate forces that resist but do not prevent deformation.
2. A first sheet comprising one or more layers and supported on its periphery by the closed loop rod.
3. A second sheet comprising one or more layers and supported along part of its periphery by the open arc rod. The second sheet also comprises an edge secured to at least the top of the first sheet. When the canopy is attached to a chair, deformation of the open arc rod puts tension on the second sheet in a way that helps give it its form.

In one preferred embodiment, one or more elastic bands are attached to the first sheet and function as the anchors fastening the first sheet to the backrest of a chair.

In another preferred embodiment, the anchors are attached to the ends of the open arc rod so that they can fasten the first sheet to the backrest of a chair.

The first and the second sheets include material that substantially block sunlight and heat radiation from the sun. In its open configuration, the first sheet is placed against the inside or outside surface of the chair backrest and fastened to the backrest by the anchors. The occupant of the chair is thereby at least partially protected from light and heat radiation from the sun.

The two sheets of the canopy can be easily folded into a compact form by stacking one on top of the other, grasping the stack with both hands and twisting and folding it into a compact configuration comprising sets of smaller rings or loops and folded sheets that can easily be stored and transported. The canopy can additionally comprise an attachment device such as a bag or a strap for maintaining the compact configuration for storage and transport, or this feature can be fulfilled by the anchors already being used to attach the canopy to a chair.

The exact shape of the closed loop rod can vary from a generally rectangular shape with slightly rounded corners to an oval or generally elliptical shape. The closed loop rod keeps the first sheet open and flat and is secured to the sheet along its periphery. In variation of this invention, portions of the first sheet can extend beyond points at which the closed loop rod is secured.

The exact shape of the second sheet includes, but is not limited to, a generally rectangular shape, a generally trapezoidal shape, the union of two generally trapezoidal shapes, and a semi-elliptical shape. The combination of the open arc and closed loop rods maintain the shape of the second sheet. A portion of the outer perimeter of the second sheet is attached to the open arc rod, and an opposite edge is attached to the closed loop rod along at least the top edge of the first sheet.

Variations include extending the second sheet beyond where the open arc rod is secured to provide more shading to the occupant of the chair. Grommets and sleeves can also be used to confine the range of motion of the open arc rod within the second sheet if it is not completely encased in the second sheet, and the shape of the second sheet can be optionally reinforced with one or more ribs.

The chair canopy of the present invention is simple. It comprises only two rods, two sheets attached to each other, and anchors to attach the canopy to a chair. It has the advantage of eliminating a substantial amount of material needed for constructing other canopies. It easily and quickly attaches and detaches to chairs' backrests. The design allows the canopy to be more easily folded, transported, unfolded, and installed than other canopies.

DETAILED DESCRIPTION

Figure 1:
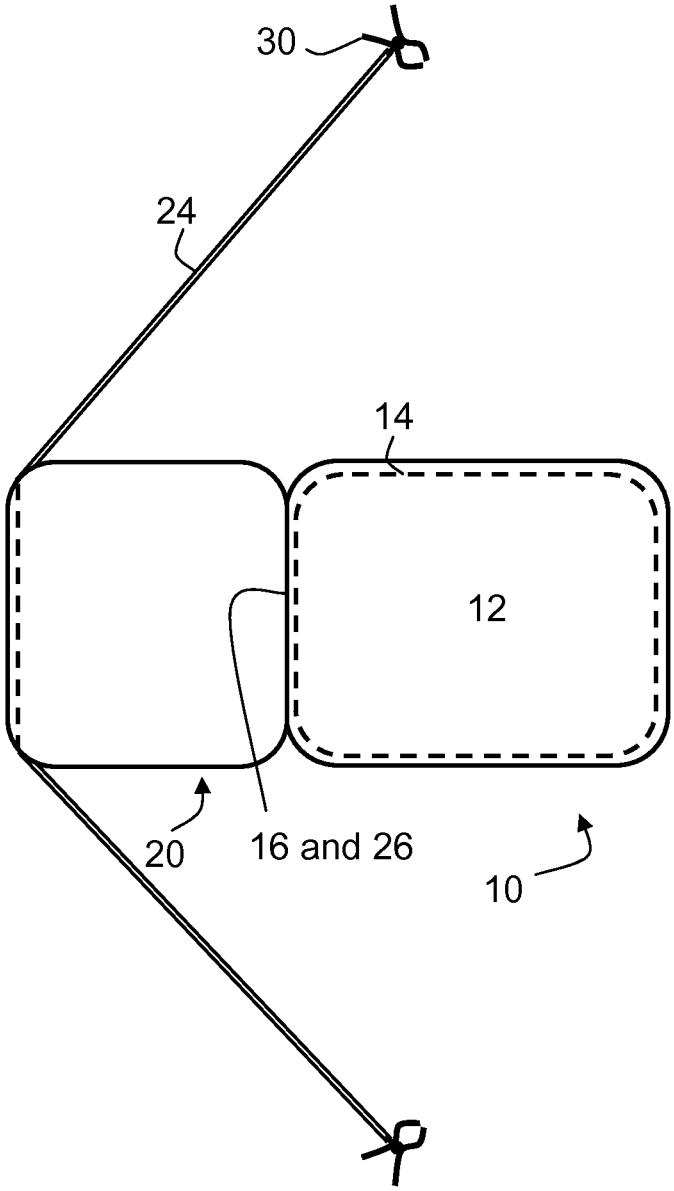
FIG. 1 is a top plan view of a preferred embodiment of the two sheets of the chair canopy of the present invention laid out flat. The two sheets are cut from a single piece of fabric or plastic and are shown with the frame secured to the sheets and with anchors configured to attach the canopy to a chair's backrest.

For ease of illustration and description, the drawings illustrate only the pertinent features of the present invention and do not show the remaining conventional features. FIG. 1 depicts a preferred embodiment comprising the following elements:

a) A first sheet 10 rectangular in shape with rounded corners comprising one or more layers of flexible material 12.
b) A flexible thin strip, wire or rod (henceforth called rod) 14, configured as a closed loop and secured to the perimeter of the first sheet 10.
c) A second sheet 20 also rectangular in shape with rounded corners comprising one or more layers of flexible material 22.
d) A rod 24 configured as an open arc and secured to a portion of the perimeter of the second sheet 20. The edge 29 of the second sheet 20 along which rod 24 is secured shall be called "top edge" of second sheet 20.

The flexible materials 12 and 22 can be conveniently made from one or more layers of a densely woven fabric made of organic, synthetic, or a mix of organic and synthetic material. In this embodiment, the sheets are made from a single piece of fabric. The bottom 26 of the second sheet 20 is attached to the top 16 of the first sheet 10. The flexible rods 14 and 24 can be made in part of spring steel, of flexible but tough plastic material, or of any other material capable of reversible deformation while generating appropriate forces in response to the deformation. Spring clips 30 secured to the ends of open arc rod 24 are used to attach the canopy to a chair.

If the sheets 10 and 20 comprise a single layer of material, the flexible rods 14 and 24 can be secured respectively to the sheets 10 and 20 by sewing hems along the perimeter of the sheets and inserting the rods 14 and 24 into the hems or by use of strips of flexible material surrounding the rods and sewn to the sheets.

If the sheets 10 and 20 comprise two or more layers of material, the outer perimeters of the layers may be sewn together with the rods 14 and 24 contained between the layers. Other ways of securing rods 14 and 24 to sheets 10 and 20 will occur to those of ordinary skill in the art. Since rod 24 is open, rod 24 can be removed from the second sheet 20 when the canopy is not in its open configuration as long as the anchors do not get in the way or can be reversibly removed.

The closed loop rod 14 maintains the first sheet 10 open and generally flat, suitable for installation against the backrest of a chair. This rod can have several different shapes. In the preferred embodiment of FIG. 1, the shape of the closed loop is rectangular with rounded corners.

Figure 2:
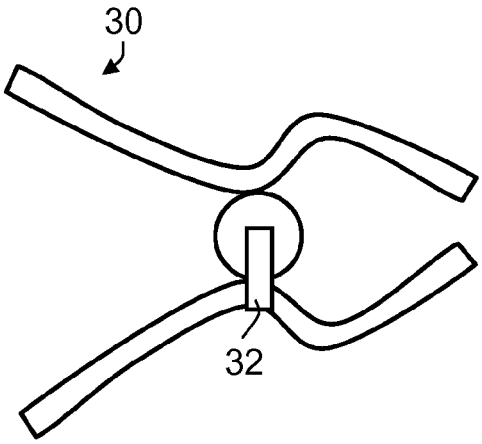
FIG. 2 provides the top view of an anchoring device including a receptacle shaped to fit onto the ends of the open arc rod.
Figure 2A:
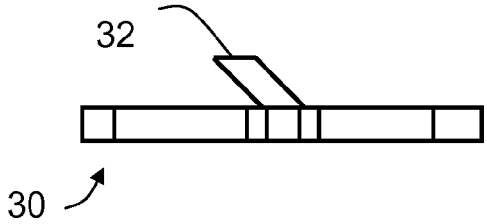
FIG. 2A provides a front view of the anchoring device.
Figure 2B:
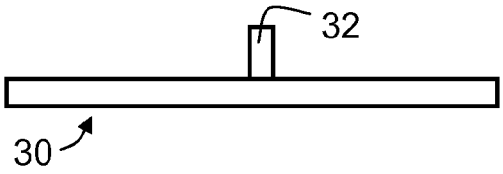
FIG. 2B provides a side view of the anchoring device.

FIGS. 2, 2A and 2B shows various views of a spring clip 30 suitable as the anchors to fasten the chair canopy to the backrest of a chair. FIG. 2 is the top view, FIG. 2A is the front view and FIG. 2B is the side view. Receptacle 32 attaches each spring clip to one end of the open arc rod. Those of ordinary skill in the art will recognize that other mechanisms can substitute for the spring clips such as, but not limited to, other types of clamps and clips, pins, screws, snaps, bolts, elastic bands, and cloth sleeves.

Figure 3:
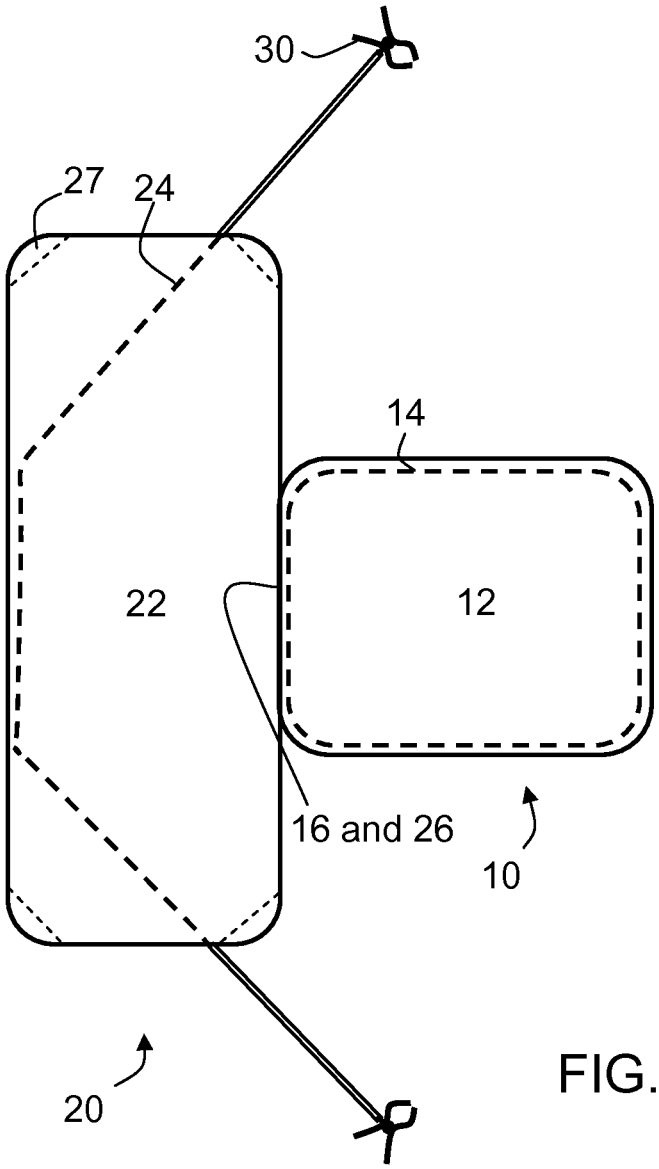
FIG. 3 is a top plan view of a preferred embodiment of the two sheets of the chair canopy. The second sheet is in the shape of a rectangle such that side panels are created when the canopy is in its open configuration. The corners are weighted to help maintain their shape.

Referring to FIG. 3, in an alternative preferred embodiment, the rectangular second sheet 20 is extended perpendicularly to the common axis shared with the first sheet 12. Each corner 27 of sheet 20 can be sewn with added weight to facilitate the extensions of sheet 20 to form side panels when the canopy is in its open configuration. This has the effect of forming an overhang to further block light and heat radiation. The open arc rod 24 can be secured to sheet 20 only at its top or at additional portions along their points of contact.

Figure 4:
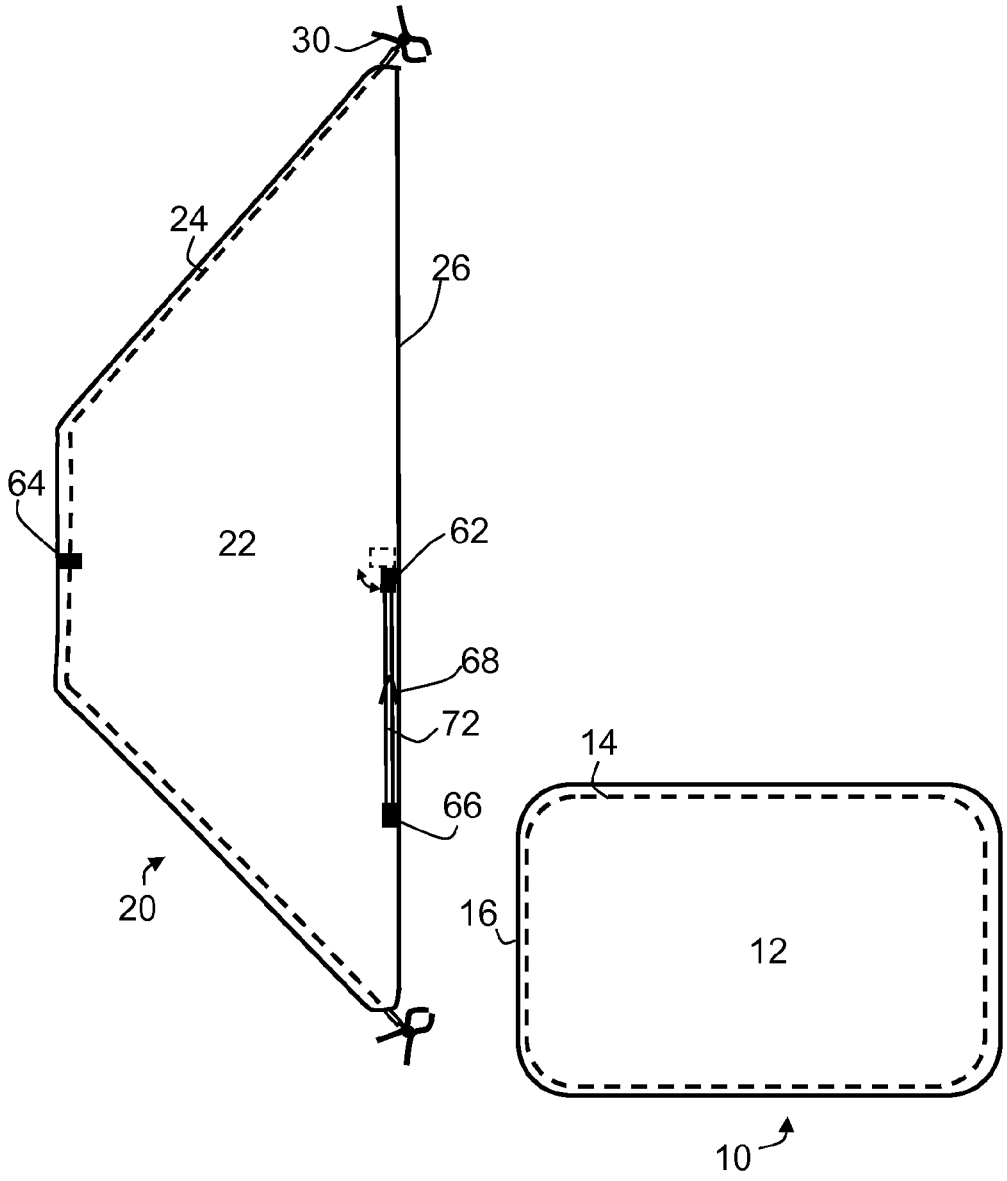
FIG. 4 is a top plan view of a preferred embodiment of the two sheets of the chair canopy of the present invention laid out flat and before they are secured together. The sheets are cut into separate pieces prior to securing them together. The second sheet comprises a union of generally trapezoidal and rectangular sections. Also shown is an optional rib to give added rigidity to the second sheet. The rib has different points of attachment, one for optional use in the canopies open configuration, and one for use during other times including storage.

FIG. 4 is an alternative preferred embodiment in which the second sheet 20 is trapezoidal or the union of trapezoidal and rectangular sections, as shown, made of flexible material with open arc rod 24 secured to a portion of the perimeter of sheet 20. A nearly closed perimeter is formed by the open arc rod 24 and the bottom edge 26. When fully assembled, the attachment of the bottom edge 26 of the second sheet 20 to the first sheet 10 covers all of the top edge 16 of the first sheet 10 and portions of both side edges of the first sheet. 10. The attachment is oriented such that the middle of bottom edge 26 is joined to the middle of top edge 16. An advantage of the shape of the second sheet 20 in this embodiment is that it forms side panels in the open configuration of the canopy that are held in place by the open arc rod 24.

To prevent the second sheet 20 from sagging during use on a chair, a rib 72 is mounted on the second sheet 20. This rib 72 is permanently secured at one end to attachment 62 and is capable of rotating freely through an arc of 90° as indicated. The rib 72 is reversibly secured at its other end to either attachment 64 or 66. If needed during use on a chair, rib 72 secured to attachment 64 helps maintain the canopy in its open configuration. When rib 72 is secured to attachment 66, it is out of the way when the canopy is folded into its storage configuration. One or more guides 68 can keep rib 72 adjacent to closed loop rod 14 during storage. As shown, attachment 62 is adjacent to closed loop rod 14, but it could just as effectively be located adjacent to open arc rod 24, with concomitant switches to attachment 64 adjacent to closed loop rod 14 and attachment 66 adjacent to open arc rod 24.

The rib is shown constructed on the outside of the canopy, but it could just as usefully be constructed on the inside surface of the canopy. An advantage of being on the outside is that it might be more easily accessible to the user. An advantage of being on the inside is that it is somewhat constrained by the sheets when it is in its storage position. The rib can be made of a flexible strip, wire or rod, either be the same or different from the material used for the closed loop rod and/or open arc rod. Attachments 62, 64, and 66 can be cloth sleeves or made of any of a number of mechanisms, or combination thereof, familiar to those of ordinary skill in the art, such as, but not limited to, hooks, loops, snaps, and hook-and-loops (Velcro®). Guide 68 can also be a cloth sleeve or made of any of a number of mechanisms, or combinations thereof, familiar to those of ordinary skill in the art, such as, but not limited to, hooks, loops, snaps, and hook-and-loops (Velcro®).

An alternative preferred embodiment for handling the rib is to construct it so that it is secured to attachments 62 and 64, both reversible attachments in this embodiment, when in use to maintain the canopy in its open configuration and then stored alongside the closed loop or open arc when not in use. The mechanism for storage could be a sleeve or snaps running adjacent to either closed loop rod 14 or open arc rod 24 or any other mechanism familiar to those of ordinary skill in the art. In this case, there is no need for attachment 66. When not in use to keep the canopy open, rib 72 is completely detached from attachments 62 and 64 and put in the mechanism for storage.

Figure 5:
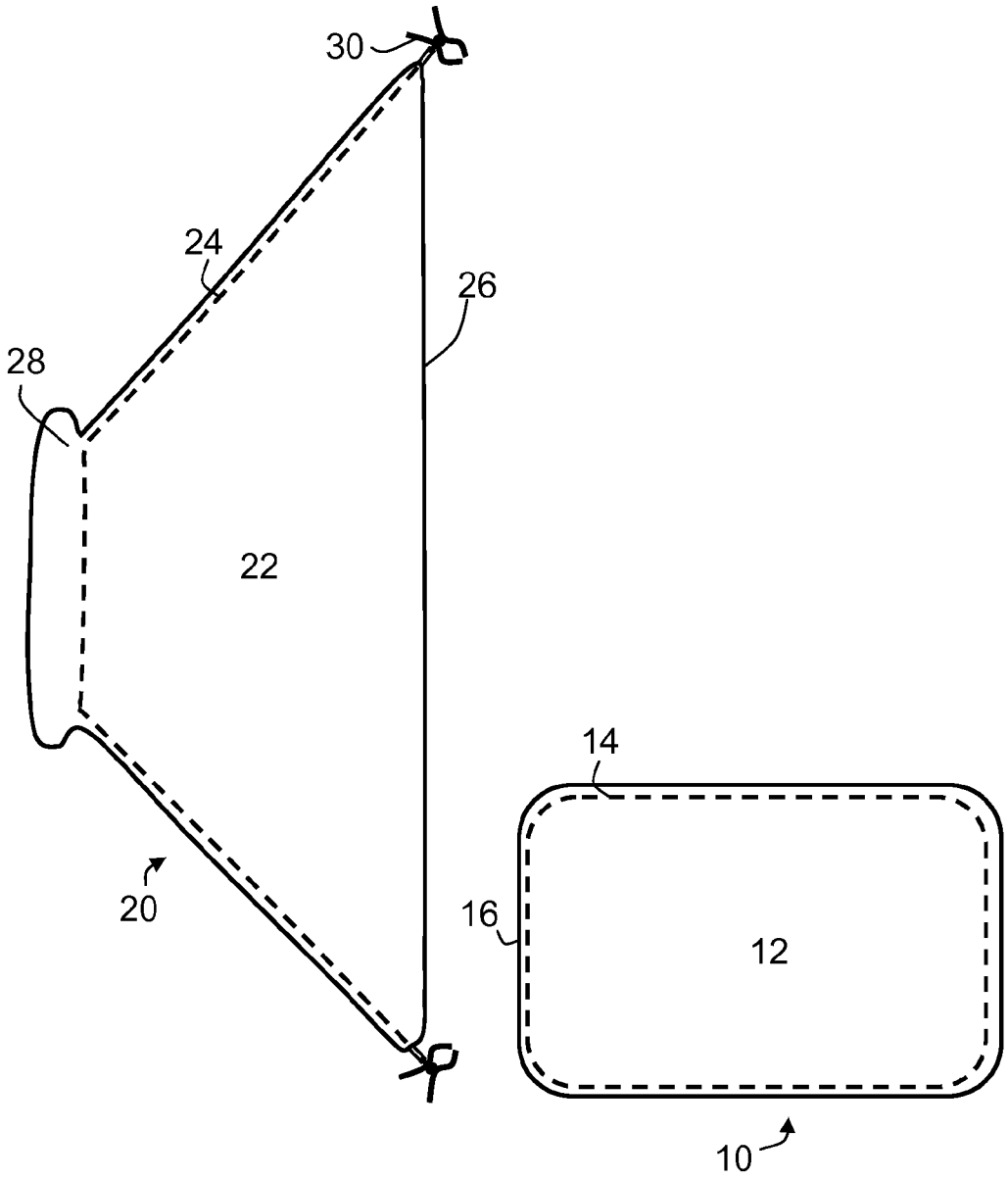
FIG. 5 is a top plan view of a preferred embodiment of the two sheets of the chair canopy of the present invention. In this embodiment, portions of the second sheet extend beyond points at which the open arc rod is secured to it in order to form an additional panel for the open canopy to provide more shading.

Referring to FIG. 5, in an alternative preferred embodiment, a portion 28 of the second sheet 20 lies outside of the perimeter formed by the open arc rod 24 to form a fringe. This has the effect of forming a front panel when the canopy is in its open configuration to further block light and heat radiation. Likewise, additional sheet material can be added along the other edges of the second sheet 20 to form larger side panels.

Figure 6:
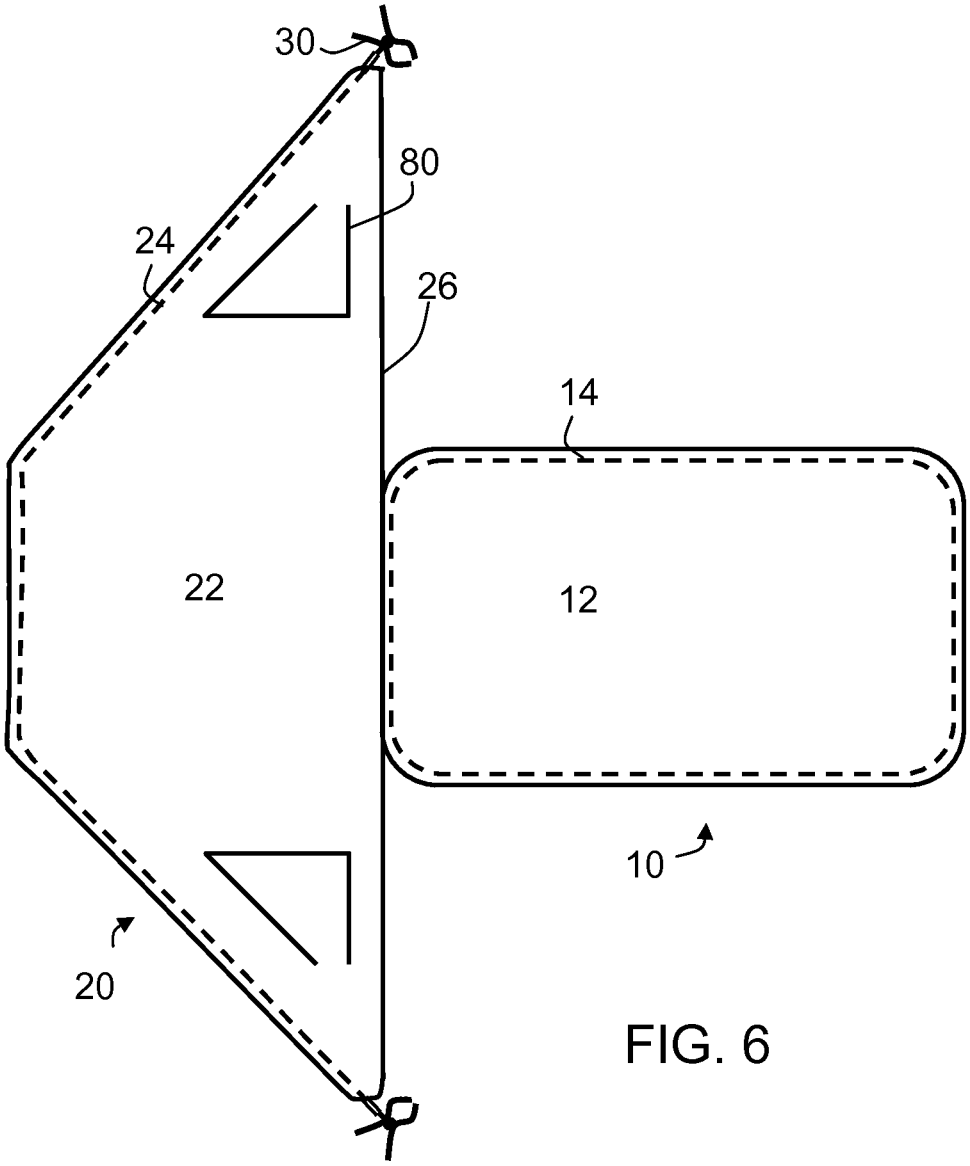
FIG. 6 is a top plan view of a preferred embodiment of the two sheets of the chair canopy of the present invention. The two sheets are cut from, and into, a single piece and are shown with the frame already secured but before the two sheets are fully sewn together. Also shown are optional window flaps for increased ventilation and user viewing.

In another preferred embodiment, FIG. 6 depicts the first sheet 10 and second sheet 20 cut from the same piece of fabric so that they share portions of a top and bottom edge, again respectively, prior to making any later attachments between the sheets. Optional window flaps 80 are cut into the second sheet 20. The window flaps can be held closed with hook-and-loop fasteners or a similar device such as a snap or other closure mechanism known to those of ordinary skill in the art. Ventilation and user visibility are increased when the flaps are open.

Figure 7:
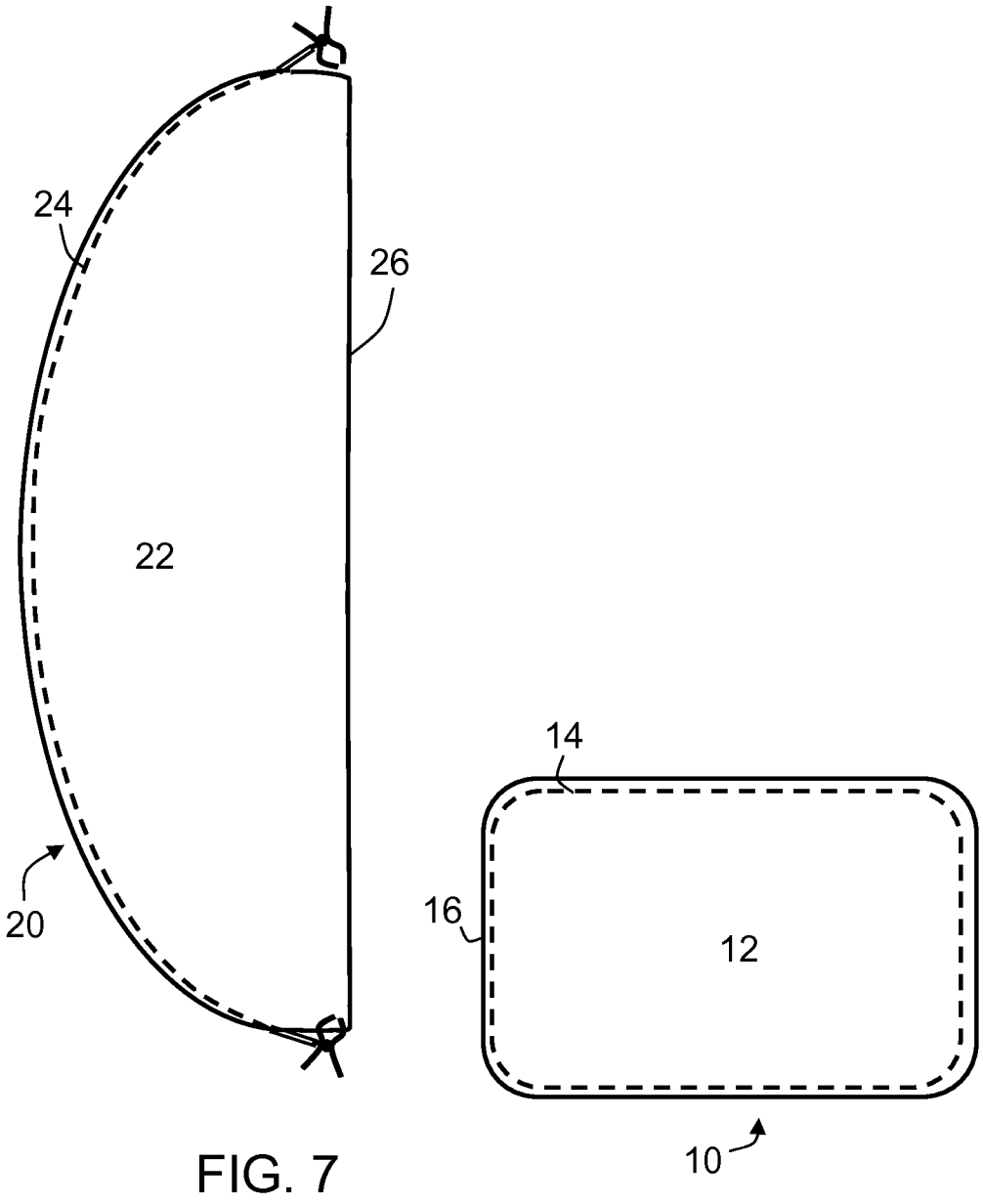
FIG. 7 is a top plan view of a preferred embodiment of the two sheets of the chair canopy of the present invention in which the second sheet comprises a semi-elliptical section in union with a rectangular section.

FIG. 7 shows another preferred embodiment of the present invention in which the second sheet 20 is shaped as the union of generally semi-elliptical and rectangular sections of flexible material with the open arc rod 24 secured to a portion of the perimeter of the second sheet 20.

Figure 8:
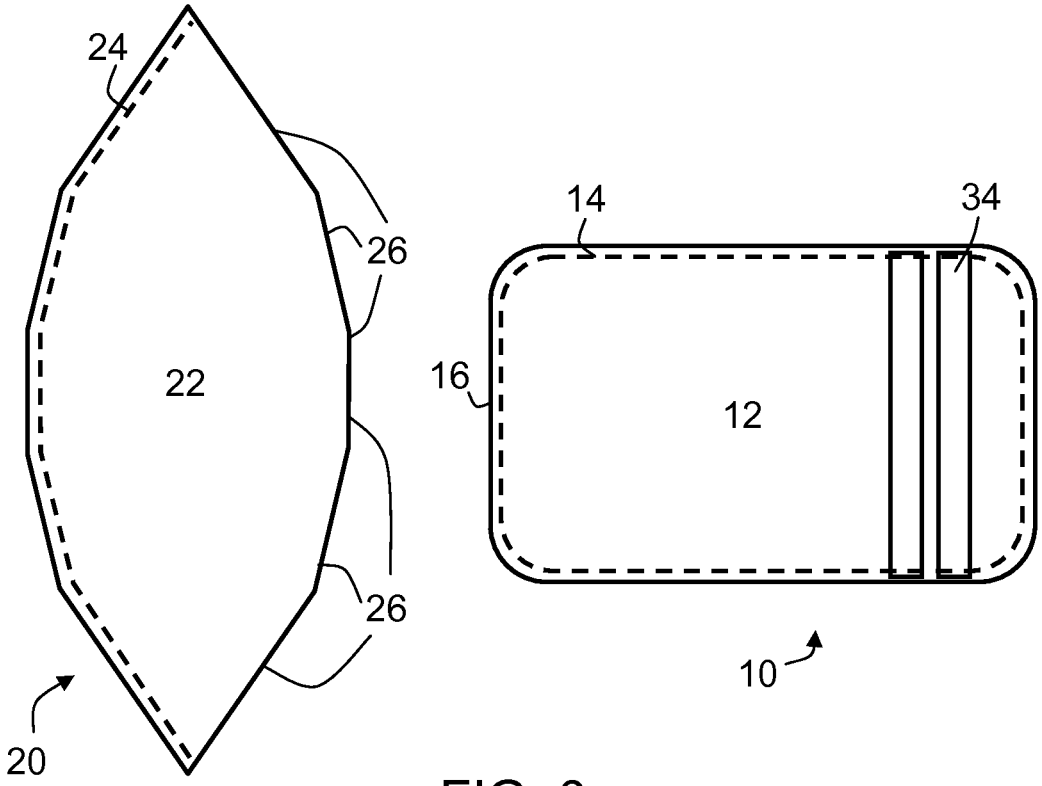
FIG. 8 is a top plan view of a preferred embodiment of the two sheets of the chair canopy of the present invention in which the second sheet comprises the union of two mirror image trapezoidal sections with rounded corners. Also shown are two elastic bands that serve as the anchors to attach the canopy to a chair.

FIG. 8 is an alternative preferred embodiment in which the second sheet 20 is shaped, when looking along its longest axis of symmetry, as the union of two mirror image trapezoidal sections with rounded corners. The corners are rounded by adding an additional linear segment as shown, just as adding an additional side to a polygon of n sides to make one with n+1 sides more closely approximates a circle. The open arc rod 24 is completely secured 29 within the perimeter of the second sheet 20, excluding the bottom edge 26 of the second sheet. When fully assembled, the middle of the bottom edge 26 is joined to the middle of the top edge 16 of the first sheet 10, and the attachment of bottom edge 26 to the first sheet 10 includes all of top edge 16 and extends symmetrically down both sides towards the bottom edge 17 of the first sheet 10. Elastic bands 34 are attached to the first sheet 10 and serve as the mechanism for anchoring the canopy to a chair. Two elastic bands are shown, but one band or more than two bands can also work. Those of ordinary skill in the art will recognize alternative anchors such as, but not limited to, straps or bands with hooks, snaps, and hook-and-loops.

There are a couple of noteworthy advantages of the embodiment of FIG. 8. The open arc, including its ends, is completely confined, making it easier to handle. In addition, the elastic bands can perform multiple functions, including anchoring the canopy to a chair in its open configuration, holding the canopy configuration set when in its collapsed storage position, and attaching the collapsed canopy to a chair during transport.

Figure 9:
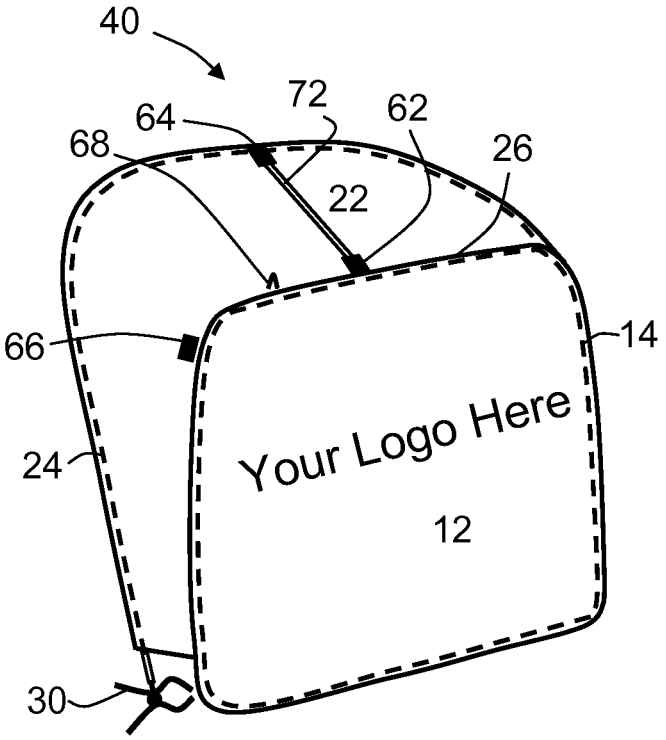
FIG. 9 is a perspective view of the chair canopy that results when the sheets of FIG. 4 are fully secured together and the canopy is in its open configuration. An optional rib is shown for maintaining the open configuration along with a guide for securing the rib to the canopy when the rib is not in use.

FIG. 9 shows a preferred embodiment of the chair canopy 40 in its open configuration. The second sheet 20 and the first sheet 10 from FIG. 4 are secured together by sewing or any other method known to those of ordinary skill in the art. The edge 26 of the second sheet 20 is attached symmetrically to the top and side edges of the first sheet 10 such that the center of edge 26 is attached to the center of edge 16.

Figure 10:
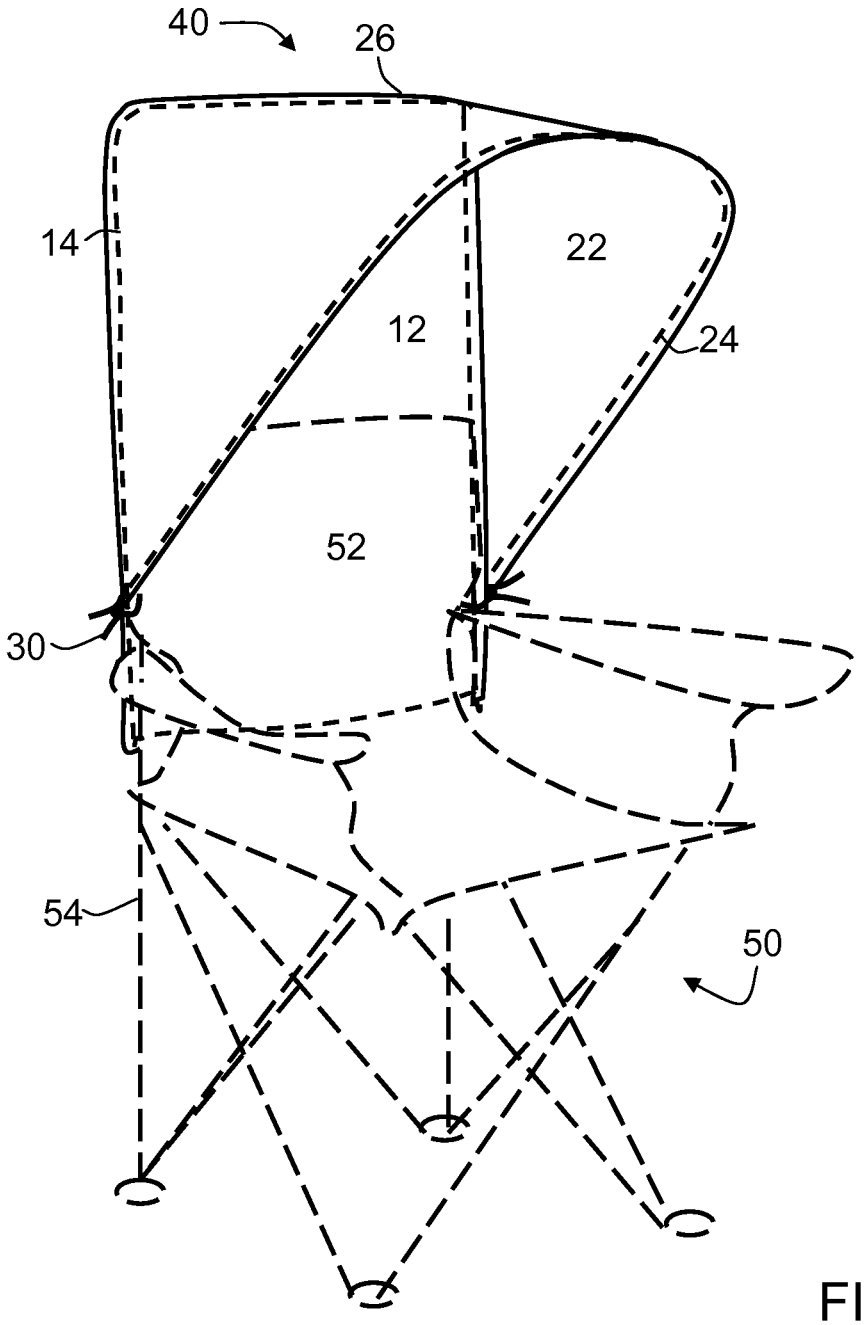
FIG. 10 is a perspective view of the front of a chair with the chair canopy of FIG. 9, absent the rib, attached to it.

Referring to FIG. 10, the chair canopy 40 from FIG. 9, without the rib, is shown installed onto chair 50 by using the spring clips 30 to anchor the canopy to the chair posts 54 and hold the first sheet flat against the chair backrest 52. The canopy is shown attached to the outside of the chair.

Figure 11:
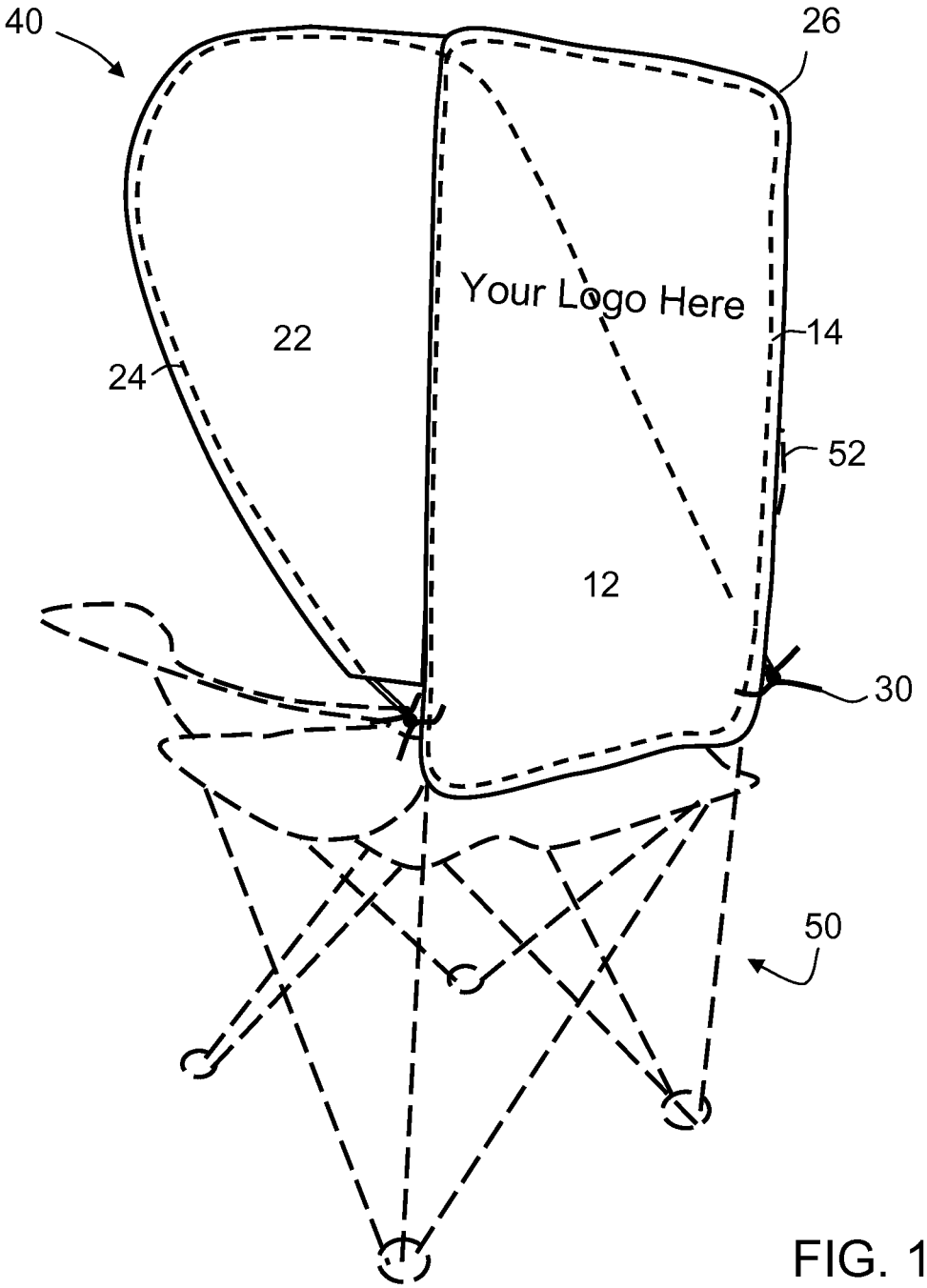
FIG. 11 is a perspective view of the back of a chair with the chair canopy of FIG. 10 attached to it.

FIG. 11 is another view of the chair canopy 40 depicted in FIG. 10. The chair canopy can easily be customized with graphics or text.

Figure 12:
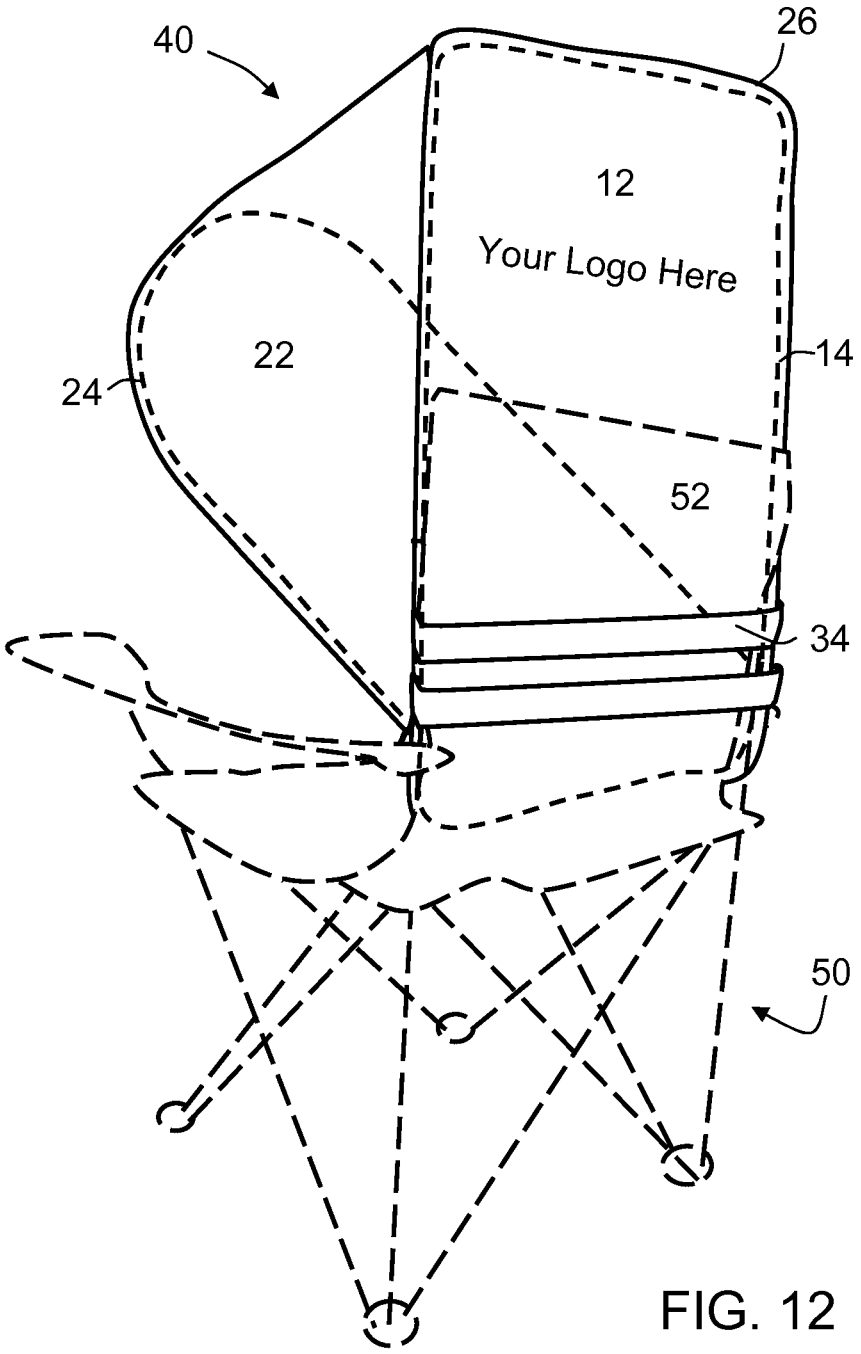
FIG. 12 is a perspective view of the back of a chair with the chair canopy of FIG. 8 attached to it.

Referring to FIG. 12, the chair canopy 40 from FIG. 8, after edge 26 of the second sheet 20 has been attached to the first sheet 10 as described earlier, is shown installed to the chair 50 using the elastic bands 34 to hold the first sheet 10 flat against the chair backrest 52. The canopy is shown attached to the inside of the chair.

The chair canopy 40 can be easily and conveniently collapsed into a compact configuration for storage when not in use. Referring to FIG. 4 or FIG. 9, if a rib is installed on the canopy, it is put in its storage position as described earlier.

Figure 13:
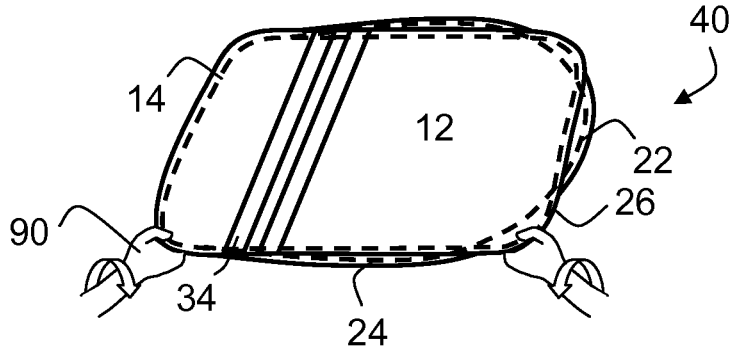
FIG. 13 shows the first step of the canopy folding process. The first sheet is folded over the second sheet thereby forming a stack. Hands are shown ready to twist the sheets in the indicated directions.
Figure 13A:
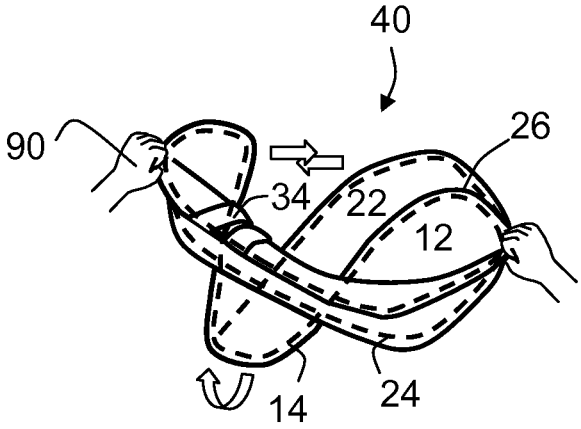
FIG. 13A illustrates the sheets as they are twisted. Three sets of stacked loops form, and the left loops are slid in front of the right loops, and the middle loops are folded in front of the left loops.
Figure 13B:
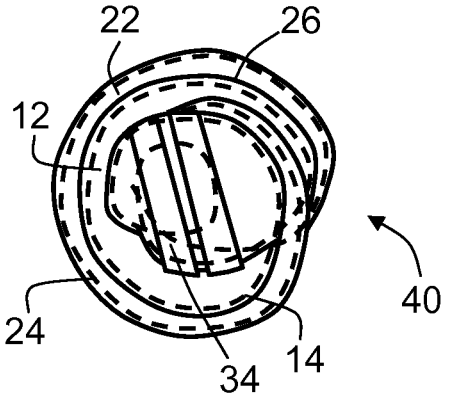
FIG. 13B shows the final compactly collapsed canopy.

The preferred method of collapsing a canopy 40 is shown in FIGS. 13, 13A and 13B. It comprises:

1. folding the first sheet 10 over the second sheet 20 along their attachment line, thereby forming a stack;
2. holding the stack at a left point and at a right point along its perimeter and twisting the stack clockwise at the left point along a first twisting axis, and twisting the stack counterclockwise at the right point along a second twisting axis. When the first twisting axis and the second twisting axis form an angle between 45 degrees and 135 degrees a set of stacked left loops, a set of stacked right loops and a set of stacked middle loops are formed;
3. sliding the left loops in front of the right loops;
4. folding the middle loops in front of the left loops.

The rods, sheets and anchors are designed so that they stack neatly and fold compactly. If additional rods and sheets are used to create a larger canopy, then they too will be designed to stack appropriately if the method described above is also used. Clearly other left/right, top/down, clockwise/counterclockwise symmetrical folding patterns can achieve the same compacting results.

The chair canopy 40 can be maintained in its collapsed configuration by using a clip, clamp, strap, snap, hook-and-loops, or any other mechanism known to those of ordinary skill in the art. In preferred embodiments, the collapsed configuration is maintained by the anchors used to attach the canopy to the chair. Referring to FIG. 13C, one of the elastic bands can be folded over from the top side to the bottom side to hold the configuration in place. In its collapsed, compact configuration, the chair canopy of the present invention can be conveniently stored in its own storage bag, in a bag used to carry the chair, or attached to the chair or chair carry bag. The lightweight construction and compactly collapsed configuration of the present chair canopy makes it particularly easy to transport conveniently attached to a beach, quad, or other chair. Referring again to FIG. 13C, the same elastic band used to hold the configuration in place can be stretched over the chair so that the chair and chair canopy are easily transported together.

Deploying the canopy is also quick and easy. Remove the collapsed canopy from the chair and unsecure the mechanism keeping the canopy collapsed, allow the stacked loops to unfold, place the first sheet against a chair backrest, use the anchors to attach the first sheet to the chair, and extend the open arc rod away from the closed loop rod until the second sheet is taught. If the canopy has a rib, it can be deployed to help prevent collapse of the second sheet.

The present invention provides for a chair canopy comprising two sheets attached together, a flexible frame that holds the sheets, and anchors to attach the canopy to a chair. The first sheet is held open by a flexible closed loop rod and the second sheet by a flexible open arc rod. In some preferred embodiments, the entire open arc rod, including its ends, can be encased in the second sheet. In this case, anchors such as elastic straps attached to the first sheet can be used to attach the canopy to a chair. In other preferred embodiments, the open arc rod includes anchors at its ends that attach the first sheet to a chair. The chair canopy can be quickly and easily opened and attached to a chair backrest, protecting the occupant of the chair from light and heat radiation from the sun. The canopy can also protect the occupant from precipitation. The canopy can also be quickly and easily removed from a chair and collapsed to a compact size for convenient storage and transportation.

It should be understood that the invention in its broader aspects is not limited to the specific embodiments shown and described herein, but departures may be made therefrom within the scope of the claims without departing from the principles of the invention and without sacrificing its chief advantages. All such modifications and changes will make themselves apparent to those of ordinary skill in the art and all such changes and modifications are intended to be covered by the claims.

While the above description contains many specificities, the reader should not construe these as limitations on the scope of the invention, but merely as exemplifications of preferred embodiments thereof. Those skilled in the art will envision many other possible variations within its scope. Accordingly, the reader is requested to determine the scope of the invention by the appended claims and their legal equivalents, and not by the examples which have been given.

We claim:

1. A canopy, adapted for use with a chair having a backrest, comprising:

b) a frame comprising two members, namely a closed loop rod and an open arc rod, each made of flexible material, said open arc rod having two ends;

c) a first sheet secured throughout its entire perimeter to said closed loop rod, first sheet having a top edge, two sides and a bottom edge;

d) a second sheet comprising a top edge and a bottom edge such that:

i. the middle of said bottom edge of said second sheet is joined by an attachment to the middle of said top edge of said first sheet, said attachment of said bottom edge of said second sheet to said first sheet includes all of said top edge of said first sheet and extends symmetrically down both said sides of said first sheet towards said bottom edge of said first sheet, and ii. said top edge of said second sheet completely confines said open arc rod; and e) one or more anchors configured to attach said canopy to said chair's backrest.

2. The chair canopy of claim 1 wherein said second sheet has the general shape of two equal size trapezoids joined along their longest parallel edges.

3. The chair canopy of claim 1 wherein said anchors comprise one or more elastic bands attached to said first sheet.

4. The chair canopy of claim 1 further comprising a flexible rib extending along said second sheet between said top edge of said second sheet and said bottom edge of said second sheet.

5. The chair canopy of claim 4 further comprising a permanent rib attachment adjacent to either said top edge of said second sheet or to said bottom edge of said second sheet.

6. The chair canopy of claim 5 further comprising two detachable rib attachments on said second sheet, first of said detachable rib attachments positioned adjacent to said top edge of said second sheet, and second of said detachable rib attachments positioned adjacent to said bottom edge of said second sheet thereby allowing said rib to be deployed when said canopy is in use or folded away when said canopy is folded.

7. The chair canopy of claim 4 also comprising a sleeve configured to store the rib.

8. The chair canopy of claim 1 further comprising a mechanism for maintaining said canopy in a compact configuration.

9. The chair canopy of claim 8 wherein said anchor is configured to attach said canopy to a chair and maintain said canopy in said compact configuration.

10. The chair canopy of claim 1 wherein said first sheet and said second sheet comprise sunlight blocking, shading or filtering material.

11. A method of folding said chair canopy of claim 1 comprising:

f) folding said first sheet over said second sheet along their said attachment line, thereby forming a stack, said stack having a perimeter;

g) holding said stack at a left point and at a right point along its said perimeter;

h) twisting said stack clockwise at said left point along a first twisting axis, and twisting said stack counterclockwise at said right point along a second twisting axis, said first twisting axis and said second twisting axis forming an angle between 45 degrees and 135 degrees, thereby forming a stacked multiplicity of left loops, a stacked multiplicity of right loops and a stacked multiplicity of middle loops;

i) sliding said multiplicity of left loops in front of said multiplicity of right loops;

j) folding said multiplicity of middle loops in front of said multiplicity of left loops.

12. The chair canopy of claim 1 wherein a fringe is added along some of the perimeter of said second sheet.

13. The chair canopy of claim 1 further comprising window flaps cut into said second sheet.

* * * * *